US007118306B2

(12) United States Patent
Kruger et al.

(10) Patent No.: US 7,118,306 B2
(45) Date of Patent: Oct. 10, 2006

(54) STORMWATER MANAGEMENT SYSTEM

(75) Inventors: Kurt J. Kruger, Hamden, CT (US); Bryan A. Coppes, Clinton, CT (US); Jonathan F. Smith, Groton, CT (US); Raymond Connors, East Haddam, CT (US)

(73) Assignee: Infiltrator Systems, INC, Old Saybrook, CT (US)

( * ) Notice: Subject to any disclaimer, the term of this patent is extended or adjusted under 35 U.S.C. 154(b) by 685 days.

(21) Appl. No.: 09/849,768

(22) Filed: May 4, 2001

(65) Prior Publication Data

US 2002/0044833 A1 Apr. 18, 2002

Related U.S. Application Data

(60) Provisional application No. 60/202,255, filed on May 5, 2000.

(51) Int. Cl.
*E02B 11/00* (2006.01)
*E01F 5/00* (2006.01)

(52) U.S. Cl. ..... 405/49; 405/46; 405/126

(58) Field of Classification Search ..... 405/43, 405/44, 46, 49, 50, 48, 47, 124, 126, 36
See application file for complete search history.

(56) References Cited

U.S. PATENT DOCUMENTS

| | | | | | |
|---|---|---|---|---|---|
| 980,442 | A | | 1/1911 | Schlafly | |
| 1,013,440 | A | * | 1/1912 | Rankin et al. | 405/43 |
| 3,495,410 | A | * | 2/1970 | Bailey et al. | 405/43 |
| 3,681,925 | A | | 8/1972 | Schmunk et al. | |
| 4,245,924 | A | * | 1/1981 | Fouss et al. | 405/45 |
| 4,360,042 | A | | 11/1982 | Fouss et al. | |
| 4,759,661 | A | * | 7/1988 | Nichols et al. | 405/48 |
| 5,087,151 | A | | 2/1992 | DiTullio | |
| 5,336,017 | A | | 8/1994 | Nichols | |
| 5,401,116 | A | * | 3/1995 | Nichols | 405/48 |
| 5,419,838 | A | | 5/1995 | DiTullio | |
| 5,437,786 | A | | 8/1995 | Horsley et al. | |
| 5,441,363 | A | * | 8/1995 | Gray | 405/49 |
| 5,511,903 | A | * | 4/1996 | Nichols et al. | 405/43 |
| 5,556,231 | A | * | 9/1996 | Sidaway et al. | 405/48 |
| 5,773,756 | A | | 6/1998 | DiTullio | 174/37 |
| 5,839,844 | A | * | 11/1998 | Nichols et al. | 405/43 |
| 6,076,993 | A | * | 6/2000 | Gray | 405/43 |
| 6,129,482 | A | | 10/2000 | DiTullio | 405/43 |
| 6,270,287 | B1 | * | 8/2001 | Gray | 405/100 |
| 6,322,288 | B1 | * | 11/2001 | DiTullio | 405/43 |

OTHER PUBLICATIONS

"Standard Specifications for Highway Bridges", Fifteenth Edition, Division I—Design, pp. 17-23, 1992.

"Standard Specification for Highway Bridges", Fifteenth Edition, Section 18, Soil-Thermoplastic Pipe Interaction Systems, Division I—Design, pp. 321-326, 1992.

(Continued)

*Primary Examiner*—Thomas B. Will
*Assistant Examiner*—Tara L. Mayo
(74) *Attorney, Agent, or Firm*—C. Nessler; Cantor Colburn LLP

(57) ABSTRACT

Disclosed is a fluid, namely stormwater, management system employing a chamber having an overall substantially constant curve cross-sectional geometry, with an a-semicircular constant curve cross-sectional geometry preferred. This chamber, which preferably follows both AASHTO standard specifications for Highway Bridges, Section 18, and Corrugated Polyethylene Pipe Association (CCPA) specifications, can further comprise corregations, support members and/or connecting elements to further add structural integrity.

8 Claims, 4 Drawing Sheets

OTHER PUBLICATIONS

"Standard Specifications for Highway Bridges", Fifteenth Edition, Section 26, Metal Culverts, Division I—Design, pp. 599-606, 1992.

"Standard Specifications for Highway Bridges", Fifteenth Edition, Section 27, Concrete Culverts, Division I—Design, pp. 607-613, 1992.

"Standard Specifications for Highway Bridges", Fifteenth Edition, Section 28, Wearing Surfaces, Division I—Design, pp. 614-618, 1992.

Cultec alleged Engineering Manual, Engineering Drawings, and other documents, including letter from Cultec Attorney. Actual public availability unknown. (Dates vary).

* cited by examiner

STORMWATER MANAGEMENT SYSTEM

CROSS REFERENCE TO RELATED APPLICATION

This application claims the benefit of the filing date of U.S. Provisional Application No. 60/202,255, filed May 5, 2000, which is incorporated herein in its entirety.

TECHNICAL FIELD

The present disclosure relates to a fluid management system, and especially relates to a stormwater containment system, which can be used beneath a parking lot.

BACKGROUND OF THE INVENTION

In cities, particularly large metropolitan areas, as more and more of the land surface becomes covered with buildings or paved with streets, parking lots, and the like, a significant problem exists with respect to the disposal of the water run-off which occurs during rain storms. Parking lots and streets typically are built with slopes toward storm drain outlets, which empty into underground storm sewers. In order to handle storm surges to inhibit overload of municipal systems, and to reduce pollutant entry into the drainage system, governments now typically require new construction sites to include a drainage management system.

Conventionally, storm drainage is often addressed using man-made ponds, large basins, or the like, designed from concrete and made to function as constructed wetlands. Because these basins are open to the atmosphere, they are subject to wide ranges of flooding and drying, with extensive evaporation frequently leading to desiccation and death of the wetland plants. An additional problem with these basins is that they form a pool, i.e., standing surface water. Unfortunately, standing water commonly result in a mosquito habitat, which can present both a nuisance and potentially a public health hazard. Furthermore, as pollutant concentrations can be expected to be high in this standing water, mosquitoes and other wildlife are subjected to elevated levels of bacteria, viruses, metals and hydrocarbons. This can result in both acute and chronic impacts to wildlife.

Alternatively, large beds of gravel surrounding a perforated pipe have been employed. In this embodiment, large pipes (diameters of 24 inches to 60 inches) are disposed horizontally in the desired drainage area at depths of up to about 4 feet. Stormwater from the surrounding area is diverted to and through the pipe when necessary.

What is needed in the art is a structurally sound, stormwater management system which does not consume development space, e.g. parking lot area, etc., and which handles the ebb and flow of the storm water.

SUMMARY OF THE INVENTION

The present disclosure relates to a stormwater containment system. This system comprises: a chamber having an overall substantially constant curve cross-sectional geometry, said chamber having a base with a flange extending outward from said base; and a plurality of protrusions which form a plurality of peaks and valleys, said corrugations disposed perpendicular to a major axis of said chamber.

The above discussed and other features will be appreciated and understood by those skilled in the art from the following detailed description and drawings.

BRIEF DESCRIPTION OF THE DRAWINGS

Referring now to the drawings, which are meant to be illustrative, not limiting, and wherein like elements are numbered alike in the several Figures.

DETAILED DESCRIPTION OF THE INVENTION

Figure 1:
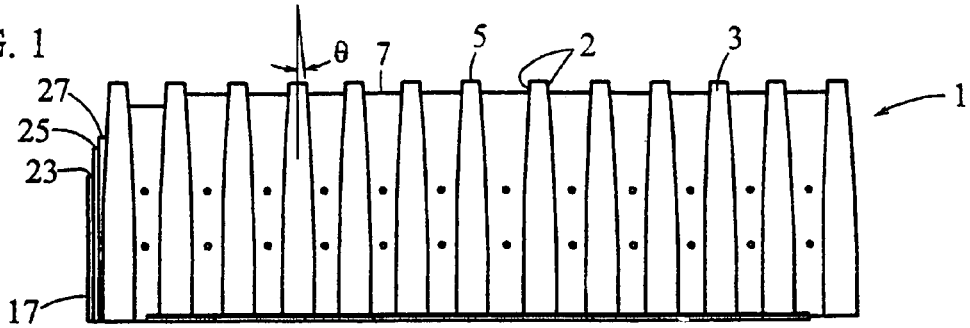
FIG. 1 is a side view of one embodiment of a stormwater chamber.

The stormwater management system comprises: a chamber having a constant curve cross-section, with fluid communication between adjacent chambers possible, if desired, and optionally structural members (e.g., protrusions, supports, and/or elements) and an engagement lip to allow overlapping chambers. Since these systems are designed for underground use, especially below parking lots, and the like, they have sufficient structural integrity to withstand typical pressures associated therewith. Consequently, these systems have been designed to follow pipe standards, namely the H-20 standard of AASHTO (American Association of State Highway and Transportation Officials) standard specifications for Highway Bridges, Section 18.

The chamber can comprise any material which is stable in the storm water environment (e.g., exposure to acid rain, hydrocarbons, oil, and other runoff pollutants, and the like), and which provides the desired structural integrity. These materials include, but are not limited to, metals (such as precious metals, titanium, ferrous materials, and the like); thermoplastic and thermoset materials (such as polypropylene, polyolefins, polyetherimide, polyethylene, particularly high density polyethylene, etc., and the like); as well as composites, alloys, and mixtures comprising at least one of the foregoing. Some examples, of high density polyethylene include Paxon® HDPE, (a bulk density of about 590 kg/m$^3$) (commercially available from Exxon Chemical), and Marlex HMX 50100 (commercially available from Phillips Chemical Company, Houston, Tex.). The specific mechanical properties of the chamber materials are chosen to meet the desired AASHTO pipe specifications. Since the properties are interrelated, it is understood that various property requirements are adjusted as other properties change and as the physical specifications of the chamber are modified. For example, a thinner chamber wall may be appropriate at a higher flexural modulus. Some preferred material qualities include the following: tensile strength at yield (using ASTM method D-638) of about 20 mega Pascals (MPa) or greater, with about 22 MPa or greater preferred; elongation at break (using ASTM method D-638) of greater than or equal to about 500%, with greater than or equal to about 800% preferred; flexural modulus (using ASTM method D-790) of about 500 MPa, with about 800 MPa to about 3,000 MPa preferred, and about 900 to about 2,300 MPa especially preferred; tensile impact (using ASTM method D-1822) of about 20 joules per square centimeter joules/$cm^2$) or greater, with about 23 joules/$cm^2$ or greater preferred; tensile impact at −40° C. (using ASTM method D-1822) of about 15 joules/$cm^2$ or greater, with about 20 joules/$cm^2$ or greater preferred; a heat deflection temperature (66 pound per square inch (psi) load, using ASTM method D-1525) of about 40° C. or greater, with about 60° C. or greater preferred; and a bulk density (using ASTM method D-1895) of about 400 kilograms per cubic meter (kg/$m^3$) or greater, with about 500 kg/$m^3$ or greater preferred. A material meeting one or more of the above material specifications may be employed with the structurally sound geometry of the chamber.

Figure 2:
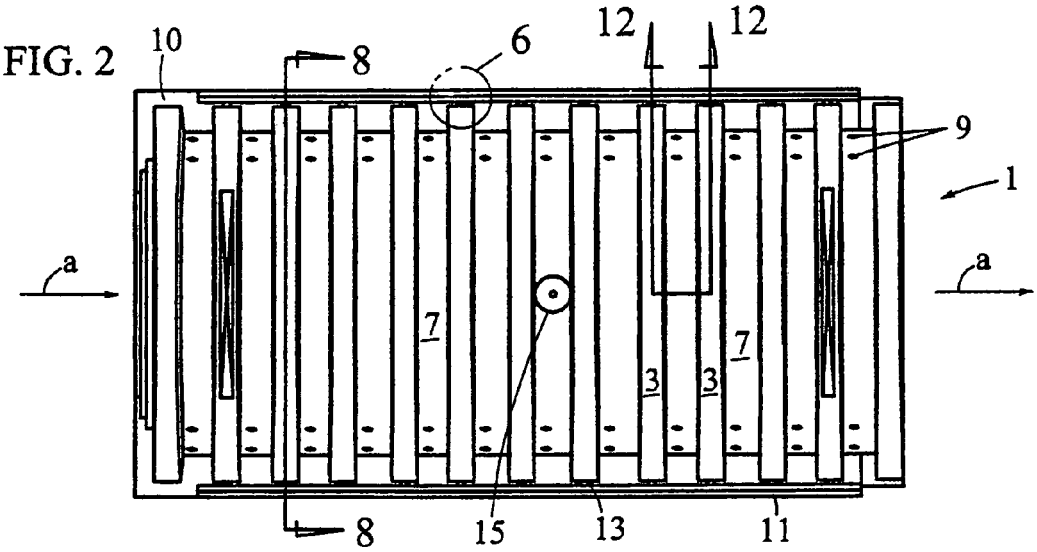
FIG. 2 is a top view of the stormwater chamber of FIG. 1.
Figure 3:
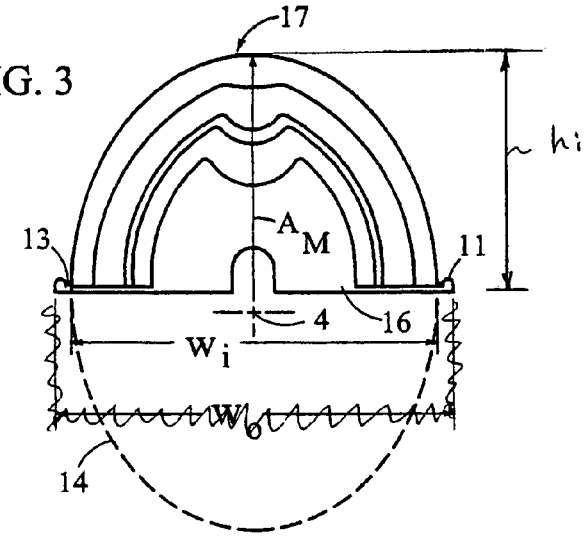
FIG. 3 is a front view of one embodiment of an end plate for a stormwater chamber.

In addition to also being designed to meet the desired structural requirements, the size and geometry of the chamber is designed to attain the desired capacity (e.g., volume). Preferably, the chamber will exceed the pipe standards of both the CPPA (Corrugated Plastic Pipe Association) and AASHTO pipe specifications for H-20 loads (dead loads, live loads, and other forces such as longitudinal, centrifugal, thermal, earth pressure, buoyancy, ice, earthquake stresses, and the like), and underground piping requirements. Possible overall chamber geometries include an arch shape, with a constant, that is, non-interrupted, curved cross-section in the direction perpendicular to the central axis "a" (FIG. 2), preferred (in other words, a cross-section (taken in the direction perpendicular to the central axis) devoid of stress risers (i.e. devoid of joints, and the like, particularly along the upper portion of the chamber (i.e., beside the joint from the chamber to the flange))). An a-semicircular constant curve cross-section is preferred (e.g., a semi-elliptical, parabolic, truncated semi-elliptical, truncated parabolic geometry, or the like) which is further asymmetrical wherein the asymmetry is in relation to the symmetry with the other, unequal "half" of the curve (e.g., the other portion of the ellipse 14 shown in phantom as on FIG. 3), and the cross-section is taken in the direction perpendicular to the central axis. For example, for a semi-elliptical geometry, the center point of the ellipse formed by the semi-elliptical geometry of the chamber, is up to about 10% below the base of the chamber. Referring to FIG. 3, the center point 4 of the major axis ($A_m$) is below the base 16 of the chamber. In other words, typically the geometry forms an inner width ($w_i$) to inner height ($h_i$) ratio of greater than or equal to about 0.5 with greater than or equal to about 1.0 preferred and greater than or equal to about 1.5 more preferred. Preferably, the width ($w_i$) to height ($h_i$) ratio is less than or equal to about 3.0, with less than or equal to about 2.5 more preferred, and less than or equal to about 2.0 especially preferred. Especially preferred is a height ($h_i$) which is up to about 49% of the major axis ($A_m$) of the ellipse, with a height ($h_i$) equal to about 44% to about 48% of the major axis ($A_m$) preferred.

With respect to the length of the chamber, although any length chamber can be employed, these chambers are typically about 2 feet (5.08 cm) to about 10 feet (25.4 cm) long, with about 4 foot (10.16 cm) to about 8 foot (20.32 cm) chambers typically preferred for ease of manufacture, shipping, handling, and installation. Since these chambers are preferably designed to be interconnected in series, the overall desired length of the chamber system is merely adjusted by the interconnected length.

Figure 4:
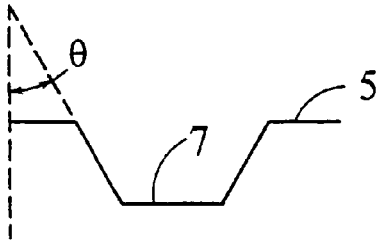
FIG. 4 is a cross-sectional view of one embodiment of corrugations taken along lines 12—12 of FIG. 2.

To further enhance structural integrity, the chamber comprises a plurality of longitudinally disposed, substantially parallel corrugations 3 which form a series of peaks 5 and valleys 7. These corrugations 3 can have any suitable cross-sectional geometry taken along lines 12—12 (see FIGS. 2 and 4), such as whole or truncated arch shaped (e.g., semi-circular, semi-elliptical, semi-hexagonal, semi-octagonal, truncated triangular, and the like), whole or truncated multi-sided (e.g., three sided, square, rectangular, trapezoidal, hexagonal, octagonal, and the like). In addition, a cross-sectional geometry along lines 8—8 (i.e., taken in the direction perpendicular to the central axis "a"), of a constant curve, concavo-concave shape preferred. (See FIG. 2) The sides of corrugations 3 preferably have an angle θ and size to optimize load bearing characteristics. Generally, the sides of corrugations 3 can have an angle θ of up to about 45°, with an angle θ of about 3° to about 35° preferred, and an angle θ of about 5° to about 25° especially preferred.

Fluid passageways 9, can be disposed through said chamber on peaks 5 and/or valleys 7, with an inspection port 15 optionally disposed at or near the top of said chamber. The fluid passageway 9 can comprise any size and geometry which attains the desired leaching capabilities without substantially adversely effecting the structural integrity of the chamber. Some possible geometries include circles, rectangles, and other multi-sided shapes, however, web-like geometries, and the like as well as combinations comprising of at least one of the foregoing.

Figure 6:
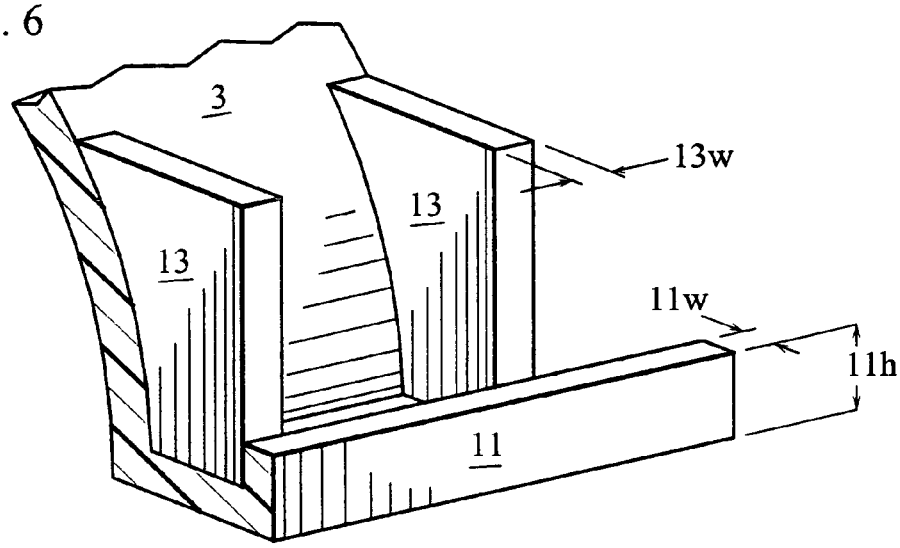
FIG. 6 is an exploded perspective view of area 6 from FIG. 2 showing another embodiment of the supporting element and connecting members.

Additional structural integrity can be supplied to the chamber by optionally employing one or more supporting element(s) 11 and/or connecting member(s) 13. The supporting element(s) 11, disposed longitudinally at or near the base of the chamber 1, substantially perpendicular to the corrugations 3 and traversing one or more, preferably two or more, of the peaks 5 and valleys 7, provide structural integrity to flange 10 in a direction parallel to the length of chamber 1, i.e., in the longitudinal direction. To provide support to flange 10 in the direction normal to the length of the chamber 1, one or more connecting members 13 can optionally be disposed on the flange 10, extending outward from the chamber 1. If the supporting element(s) 11 are employed, the connecting member(s) 13 can be disposed between the chamber 1 and the supporting element(s) 11 or extending outward from supporting element(s) 11. Preferably, connecting member(s) 13 are in physical contact with both the supporting element(s) 11 and the peak(s) 5 and/or valley(s) 7 of the chamber 1, with two connecting members 13 disposed in physical contact with a corrugation 3 preferred. (See FIG. 6)

Both the supporting element(s) 11 and the connecting member(s) 13 can be solid or hollow; homogenous, filled, or a composite; and can have any geometry which provides the desired structural integrity. Some possible geometries include those employed for the corrugations 3. Furthermore, the size of the supporting element(s) 11 and the connecting member(s) 13 can be similar, with the supporting element(s) 11 preferably having a height equal to or less than or equal to the height of the connecting members 13. A connecting member height of about 100% to about 600% of the supporting element height is preferred, with a height of about 300% to about 500% of the supporting element height especially preferred. Although a connecting member height up to about 15% of the height of the chamber and a width up to about 95% or more of the width of the flange 10 can be employed, a height of about 2% to about 12% of the height of the chamber and a width up to about 80% of the width of the flange 10 are typically employed, with a height of about 5% to about 10% of the height of the chamber preferred.

The length of the supporting element(s) 11 should be sufficient to impart the desired structural integrity to the flange 10. Generally the length of the supporting element(s) 11 is up to about 100% of the length of the chamber 1, with a length up to about 70% of the length of the chamber 1 typically sufficient. Alternatively, supporting element(s) 11 can comprise a plurality of elements longitudinally disposed, intermittently down the length of the flange 10, with each element preferably having a length which spans at least one peak or valley, with a length spanning several peaks and valleys preferred.

Although the supporting element(s) 11 can be disposed at any point across the width of the flange 10, it is preferred that the support element(s) 11 be disposed in a spaced relationship to the base of the peaks and valleys with the connecting member(s) 13 disposed therebetween. In this embodiment, the connecting member(s) 13 preferably have a length substantially equivalent to the distance between the supporting element(s) 11 and the base of the peaks 5 and/or valleys 7. Alternatively, the connecting member(s) 13 can have a length substantially equivalent to the width of the flange 10, wherein either the supporting element(s) 11 would not be employed or the supporting element(s) 11 would be intermittently and longitudinally disposed on the flange 10. Generally, the length of the connecting member(s) 13 is up to about 5 inches (12.7 centimeters (cm)), with about 0.5 inches (1.27 cm) to about 4 inches (10.16 cm) typical.

For example, for a 7.5 (228.6 cm) to 8 foot (243.8 cm) chamber having a height of about 20 inches, a width of about 38 inches, and an a-semicircular constant curve chamber geometry, the supporting element(s) 11 can have a height of about 0.6 inches (1.52 cm), a width of about 0.7 inches (1.78 cm), and a length of about 5 feet (152.4 cm) to about 5.5 feet (167.6 cm), with a three-sided square geometry. Similarly, connecting member(s) 13 can have a three-sided square geometry, with a height of about 0.3 inches (0.76 cm), a width of about 0.5 inches (1.27 cm), and a length of about 0.53 inches (1.35 cm). Alternatively, for a different 7.5 (228.6 cm) to 8 foot (243.8 cm) chamber having a height of about 20 inches, a width of about 38 inches, and an a-semicircular constant curve chamber geometry, the supporting element(s) 11 can have a height of about 0.5 inches (5.08 cm), a width of about 0.3 inches (0.76 cm), and a length of about 5 feet (152.4 cm) to about 5.5 feet (167.6 cm), with a three sided square geometry. Similarly, connecting member(s) 13 can have a three-sided square geometry, with a height of about 2.5 inches (6.35 cm), a width of about 0.188 inches (0.478 cm), and a length of about 0.53 inches (1.35 cm). (See FIG. 6)

Figure 7:
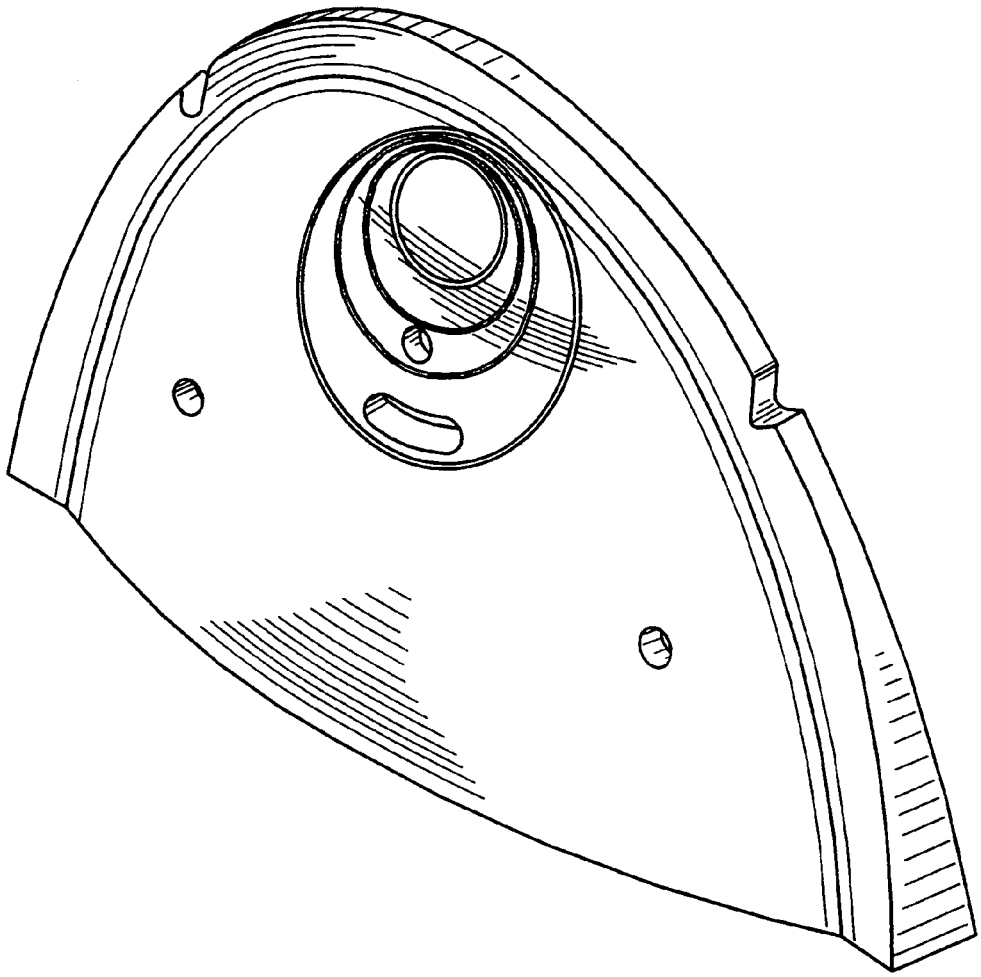
FIG. 7 is a front perspective view of another embodiment of an end plate having a bowed or convex portion.
Figure 8:
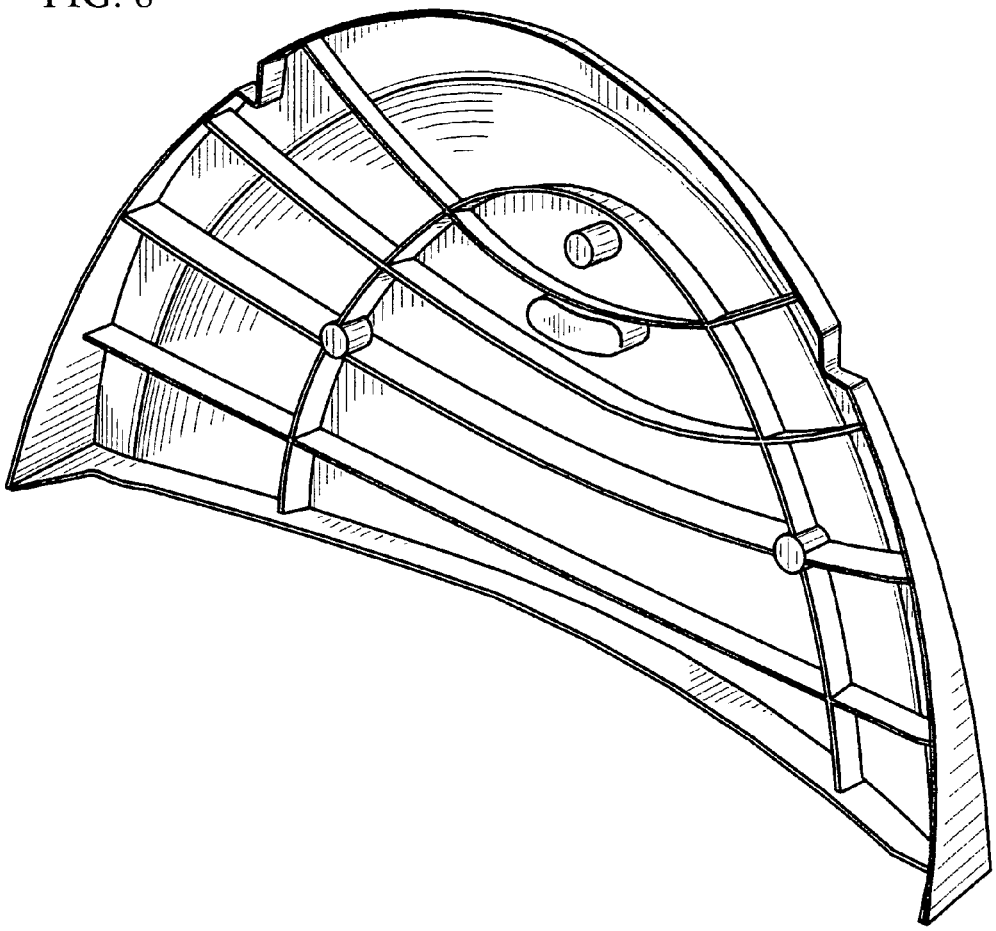
FIG. 8 is a back perspective view of the end plate of FIG. 7 having a bowed or convex portion.

Further structural integrity can be obtained using an endplate, baffle, or the like. The endplate 17, optionally disposed on one or both ends of the chamber or series of chambers and/or at various points therebetween, preferably comprises a material and geometry that imparts the desired structural integrity to the chamber and endplate. (See FIG. 3) The endplate 17 cross-sectional geometry is preferably substantially similar to the geometry of the chamber where the endplate 17 will be attached so as to inhibit soil intrusion when installed underground. Consequently, the endplate cross-sectional geometry taken perpendicular to, the axis (A) is preferably a substantially constant curve (e.g., a semi-elliptical geometry or the like as described for the chamber), while the cross-sectional geometry taken parallel to the axis (A) is a semi-rounded design (e.g., bowed, semi-spherical, plano-convex, convexo-concave, convexo-convex, and the like, with a convexo-concave and plano-convex preferred) (see FIGS. 7 and 8).

Although, the geometry dimensions of the endplate 17 can be any dimensions, which impart the desired structural integrity. For example, the endplate 17 can fit within the end of the chamber 1, interconnecting to the chamber with protrusions (not shown) which engage divots or openings in the chamber 1. Alternatively, the endplate 17 can comprise a flange or barrier disposed about its periphery. Disposed on the flange can be one or more snap connectors that engage a lip at the opening of the chamber. The endplate 17 dimensions are preferably a ratio of width (w) to height (h) of up to about 3.0, with a ratio of up to about 2.0 preferred, and a ratio of up to about 1.75. Also preferred is a width (w) to height (h) ratio of greater than or equal to about 1.0, with greater than or equal to about 1.25 preferred and greater than or equal to about 1.5 especially preferred The face 21 of the endplate 17 can similarly have any geometry and design that imparts the desired structural integrity to the management system. Preferably the endplate 17 is designed to be used as an endplate (at one or both ends of the management system), or as a support and/or a baffle (within the management system). Typically, at least one endplate (baffle) is located at or near each end of each chamber. Consequently, although subsequent chambers interconnect, a support would be employed at or near the interconnection point to ensure the desires structural integrity of the system. Optionally, an endplate can be disposed in one or several of the corregations 3 along the length of the chamber to further enhance the structural integrity of the chamber.

One or both sides of the endplate 17 can have one or more fluid ports that allow the fluid, i.e. storm water and other runoff (hereinafter storm water), to pass into the chamber 1 or between connected or adjacent chambers. Also, steps 23, 25, 27, and others can optionally be disposed on the face 21 to accept and support a conduit, such as a drainage pipe or the like. Consequently, the steps 23, 25, 27 preferably have a substantially concave upper portion, with a general geometry similar to that of the end plate. Alternatively, pipe scores can be employed to enable simplified cutting of the end plate to allow acceptance of a conduit.

The endplate 17 can further comprise other features to simplify handling and/or improve use. Possible additional features include: conduit stops to inhibit the conduit from engaging a second side of the endplate and blocking flow, thereby causing the storm water to drain through the conduit, into the endplate, through the endplate, and into the chamber; a splash plate disposed at the base of the endplate extending into the chamber to prevent erosion of the soil in the chamber due to the entrance of stormwater from the conduit and/or endplate; an internal channel for stormwater flow through the endplate; support stations on one or both sides of the endplate to provide structural integrity to the endplate; and the like, as well as conventional endplate features.

Although the endplate 17 can be made from any material which is stable in the storm water environment and that provides the desired structural integrity, for ease of manufacture, economies, for improved performance due to matching coefficients of thermal expansion, etc., the endplate 17 is preferably composed of the same material as the chamber 1. Generally, the endplate is hollow structure, although the interior can optionally comprise a foam or other reinforcing material.

Furthermore, the chambers and endplates can be formed separately or insitu using various molding techniques, such as injection molding, vacuum forming, press forming, rotational molding, blow molding, compression molding, and the like. For purposes of economies, inventory and handling, the chambers and endplates are preferably formed insitu, wherein the endplates are formed integral with the chambers. One or both of the endplates can subsequently be removed (either in the manufacturing facility, at the storage facility, by the end-user, or otherwise), or maintained as a single unit.

The chambers can be installed underground, below parking lots and other areas where stormwater management is desired. For example, a hole about 4 feet (10.16 cm) deep, having a width and length consistent with the number of chambers desired, is formed. The chambers are then placed in the hole, with subsequent chambers connected to previous chambers by means of a fluid conduit or by merely overlapping of one or more peaks and/or valleys near an end of one chamber and the beginning of the subsequent chamber. Below the overlapping section, a support or baffle (e.g. endplate) is preferably disposed to obtain the desired structural integrity. Typically, the largest step or pipe score is been removed from the support to enable ready passage of storm water between subsequent chambers.

The stormwater management system of the present invention eliminates problems associated with conventional water basin type systems, including standing water issues and consumption of land by the basins. The system, which employs a non-interrupted constant curve cross-sectional geometry which eliminates stress risers of conventional designs, follows pipe standards of both AASHTO standard specifications for Highway Bridges, Section 18, and Corrugated Polyethylene Pipe Association (CCPA) specifications, as can be seen in the Table below. The Table sets forth safety test data (AASHTO H-20 specification) for a chamber of the present invention having a material thickness of about 0.100 inches (0.254 cm) to about 0.425 inches, and a flexural modulus of about 1,070 MPa (about 155,000 pounds per square inch).

TABLE

| Depth (in) | 6 | 12 | 18 | 20 | 24 |
|---|---|---|---|---|---|
| q/q° Peak (%) | 0.9 | 0.62 | 0.3 | 0.35 | 0.3 |

TABLE-continued

| Depth (in) | 6 | 12 | 18 | 20 | 24 |
|---|---|---|---|---|---|
| Impact load | 1.3 | 1.3 | 1.2 | 1.2 | 1.2 |
| 14,100 lb/ft$^2$ | 1+ | 1.45 | 2.5 | 2.79 | 3.25 |
| 16,000 lb/ft$^2$ | 1+ | 1.28 | 2.20 | 2.45 | 2.86 |

Testing of chambers was conducted in a controlled field environment. Loads, transferred through soil were converted to pressure applied to a buried structure by varying the load based upon: the depth of the soil, the compaction level, moisture content, and type of soil. Since it is impractical to utilize a vehicle (and almost impossible) that would impart an H-20 load times the desired safety factor of two (2), the effective pressure on the buried structure was extrapolated using the boussinesq expression (see pressure bulbs in: Bowles, J. E., Foundation Analysis and Design, 5$^{th}$ Edition, McGraw-Hill, N.Y. (1996), FIGS. 5–4, p. 292). Consequently, in order to determine the pressure (i.e., load), applied to a buried structure with a H-20 load, a boussinesq curve distribution was used to calculate the effect on the structure.

Referring to the Table, the q/q$^0$ relationship refers to the pressure exerted on the structure at a given cover. For example, at 6 inches of cover, 90% of the load is imparted to the buried structure from the vehicles. Also, an impact factor is applied to take into account the dynamic force of the vehicle. By loading the chamber at 6 inches of cover with an H-20 load, the boussinesq calculation can calculate the effective load had it been applied at 18 inches.

As can be seen from the Table, the chamber attains high structural integrity, e.g., a safety rating of greater than or equal to about 1 for AASHTO H-20 , with a rating of greater than or equal to about 2 for compact earth coverings of at least about 18 inches (45.72 cm), wherein the compaction is in accordance with ASTM D2321 and D2487, and AASHTO M43. Table 2 sets for some exemplary materials and standards.

TABLE 2

| | ASTM D2321 | | ASTM D2487 | | M43[3] | Compaction/Density |
|---|---|---|---|---|---|---|
| | N[2] | Description | N[2] | Description | N[2] | Requirement |
| Washed crushed stone[1] | IA | Open-graded clean manufactured aggregates | GW | Angular crushed stone, crushed gravel, crushed slag; large voids with little or no fines[4] | 5<br>56 | Base: at least 2 perpendicular passes of vibratory roller with full dynamic force.<br><br>Cover: Compact with a walk-behind plate compactor or vibratory roller, dynamic force less than 10,000 lbs. |
| graded granular soil | II | Clean course-grined soils | GW-GM | gravel, gravel/sand mixtures <5% fines[4] | 57<br>6<br>67 | Cover: Compact to a minimum of 95% standard proctor density in 6 in. lifts. Use a vibrator roller with a max. gross vehicle weight of 12,000 lb and a max. dynamic force of 20,000 lb. |
| | III | course-grained soils with fines | GW-GC | gravel with sand/silt mixtures 5–12% fines[4] | gravel and sand with <10% fines[4] | |

TABLE 2-continued

| | ASTM D2321 | | ASTM D2487 | | M43[3] | Compaction/Density |
|---|---|---|---|---|---|---|
| | N[2] | Description | N[2] | Description | N[2] | Requirement |
| sand | N/A | N/A | SW | sands, gravelly sands; <5% fines[4] | N/A | Cover: Compact to a minimum of 95% standard proctor density in 6 in. lifts. Use a vibratory roller with a max. gross vehicle weight of 12,000 lb and a max. dynamic force of 20,000 lb. |
| | | | SW-SM | sand with gravel/silt mixtures 5–12% fines[4] | | |
| | | | SW-SC | sand with clay (or silty clay)/gravel mixtures 5–12% fines[4] | | |

[1]1.5 to 2 inches in size
[2]Notation
[3]AASHTO
[4]fines refers to soil passing during #200 sieve analyses.

For example, when the chambers are disposed in the ground, with at least about 18 inches of compacted cover (e.g., sand, clay, soil, gravel, stone, or a combination comprising at least one of the foregoing covers) disposed over the chambers, the fluid management system will have a safety rating of greater than or equal to about 1.95 under AASHTO H-20

In contrast, conventional systems, which often employ a geometry having a curved upper surface with substantially straight sides, fail to meet such rigorous structural integrity standards, and/or fail to maintain such structural integrity for a period of time needed in these applications, i.e. up to about 30 years. Tests as set forth above employed two controls, Control A being a conventional septic system leaching chamber having stress risers, and Control B being a corrugated, double-walled pipe having a 36 inch diameter. Both of these Controls failed, i.e., collapsed, as was evidenced by visual inspection showing deformities and/or breakage. Control A collapsed at an axle load of 22,750 pounds (lbs.) (11,380 lbs. per tire), with a 12 inch (30.48 cm) cover. Meanwhile, Control B collapsed at an axle load of 28,220 pounds (lbs.) (14,100 lbs. per tire), with a 6 inch (15.24 cm) cover.

Figure 5:
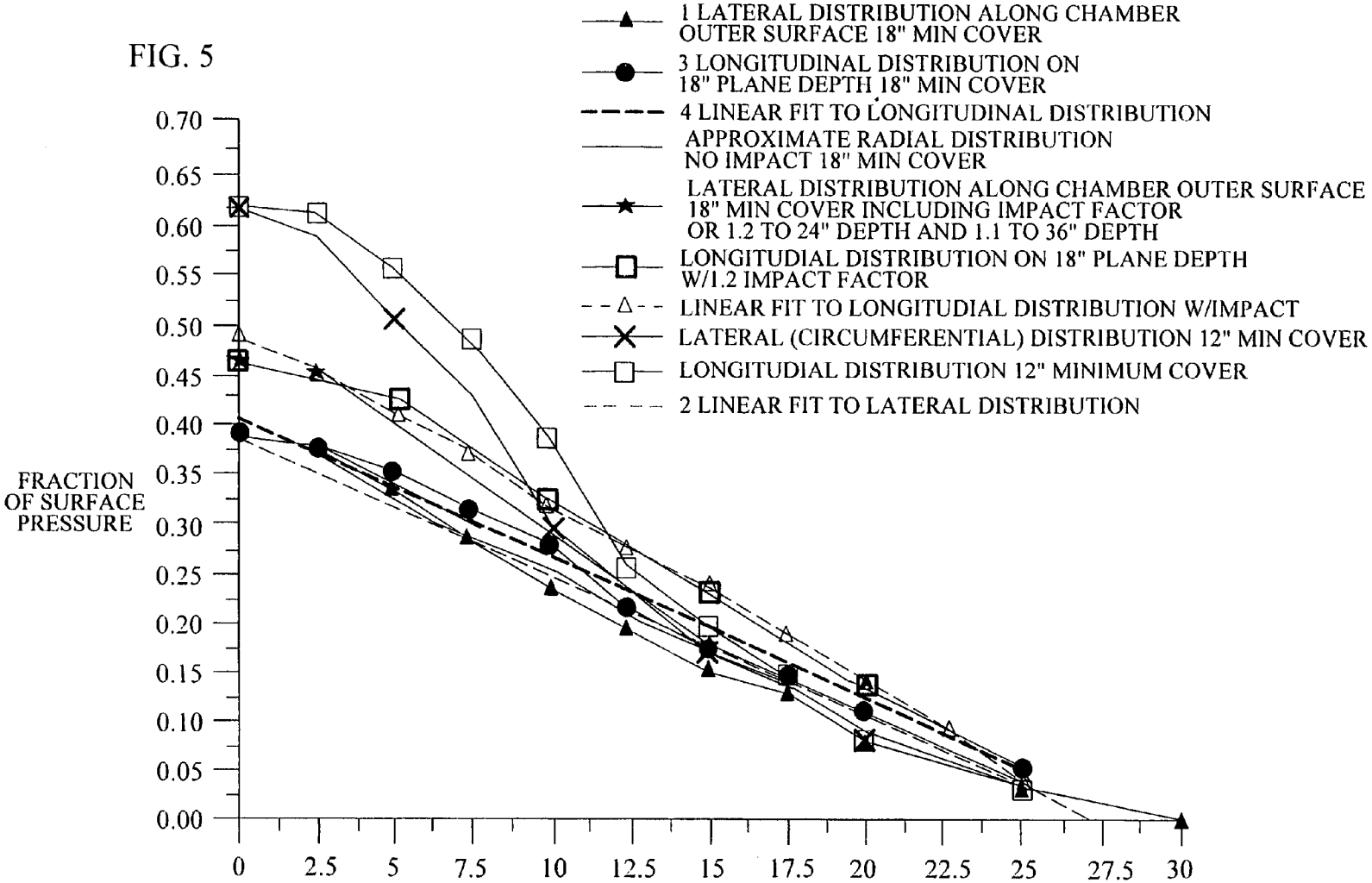
FIG. 5 is a graphical representation of the fraction of surface pressure distribution in the longitudinal and lateral (circumferential) directions for one embodiment of the chamber, using boussinesq methodology.

Referring to FIG. 5, which further illustrates the fraction of surface pressure distribution in longitudinal and lateral (circumferential) directions using a boussinesq methodology and assuming a 20 inch by 20 inch square foundation for the load. As can be seen generally, as you move from the center, the fraction of the load applied to the chamber decreases.

In conventional chambers, the points where the sides meet the curved upper portion are areas of initial deflection (i.e., stress risers), which lead to stress cracks and failure. In contrast, the chambers of the stormwater management system disclosed herein follows or exceeds AASHTO pipe standards for a period of time of more than about 30 years, with up to and exceeding about 50 years attainable.

It is hereby understood that the stormwater management system can be employed in other fluid management applications, including, but not limited to, septic system leaching fields.

While preferred embodiments have been shown and described, various modifications and substitutions may be made thereto without departing from the spirit and scope of the invention. Accordingly, it is to be understood that the present invention has been described by way of illustration and not limitation.

We claim:

1. In a corrugated arch shape cross section chamber, for receiving and dispersing stormwater when buried in compactable media, wherein opposing chamber sidewalls run upwardly from the chamber base to the chamber top to define an arch shape cross section geometry having an inner height H, measured along the central vertical axis of the cross section, and an inner width W, measured horizontally at said base; the improvement which comprises: an arch shape cross section geometry which is a truncated semi-ellipse having a major axis lying along said vertical axis.

2. The improved chamber of claim 1, wherein the chamber has a width to height ratio (W/H) between about 0.5 to 1 and 2 to 1.

3. The improved chamber of claim 2 in combination with a domed endplate, wherein the endplate is engaged with an end of the chamber.

4. The improved chamber of claim 1, wherein W/H is between 1 to 1 and 2 to 1.

5. The improved chamber of claim 1, wherein the height H of the chamber is between about 44 and 48 percent of the length of the major axis of the ellipse of which the truncated semi-ellipse is a portion.

6. The chamber of claim 5, wherein the improvement further comprises a plurality of connecting elements on each opposing side of the chamber, running transverse to the length of the chamber, from the support member to the sidewall of the chamber.

7. The chamber of claim 1, wherein the improvement ftirther comprises an outwardly extending flange running along the base of each of said opposing sidewalls; and, a support member running upwardly from the outermost edge of each said flange.

8. The improved chamber of claim 1 in combination with a domed endplate, wherein the endplate is engaged with an end of the chamber.

* * * * *